US005385088A

United States Patent [19]

Grabscheid

[11] Patent Number: 5,385,088

[45] Date of Patent: Jan. 31, 1995

[54] PRESS HAVING GUIDE FOR BEARING BRACKETS

[75] Inventor: Joachim Grabscheid, Heuchlingen, Germany

[73] Assignee: J.M. Voith GmbH, Heidenheim, Germany

[21] Appl. No.: 98,364

[22] PCT Filed: Dec. 10, 1992

[86] PCT No.: PCT/DE92/01030

§ 371 Date: Aug. 9, 1993

§ 102(e) Date: Aug. 9, 1993

[87] PCT Pub. No.: WO93/12290

PCT Pub. Date: Jun. 24, 1993

[30] Foreign Application Priority Data

Dec. 11, 1991 [DE] Germany ..... 4140876

[51] Int. Cl.[6] ..... B30B 3/04; D21F 3/02

[52] U.S. Cl. ..... 100/168; 72/237; 100/162 B; 100/153; 162/358.3

[58] Field of Search ..... 100/153, 162 B, 168–171; 72/237, 240, 245, 246; 162/272, 273, 358.1, 358.3, 360.2, 360.3

[56] References Cited

U.S. PATENT DOCUMENTS

| | | | |
|---|---|---|---|
| 1,864,299 | 6/1921 | Fawell | 72/246 X |
| 3,638,467 | 2/1972 | Fujino | 72/237 |
| 3,921,514 | 11/1975 | Biondetti | 100/170 X |
| 3,946,587 | 3/1976 | Maltby | 72/237 |
| 4,238,947 | 12/1980 | Graham et al. | 72/237 |
| 4,715,206 | 12/1987 | Forni | 72/237 |
| 4,817,407 | 4/1989 | Alich | 100/162 B X |

FOREIGN PATENT DOCUMENTS

| | | | |
|---|---|---|---|
| 0328844 | 8/1989 | European Pat. Off. . | |
| 900534 | 7/1945 | France | 72/245 |
| 1442365 | 5/1966 | France | 72/245 |
| 3906618 | 9/1990 | Germany | 72/237 |
| 9200952.2 | 4/1992 | Germany . | |
| 1292331 | 10/1972 | United Kingdom | 100/168 |
| 92/17641 | 10/1992 | WIPO . | |

*Primary Examiner*—Stephen F. Gerrity
*Attorney, Agent, or Firm*—Ostrolenk, Faber, Gerb & Soffen

[57] ABSTRACT

A press includes at least two press units supported by respective bearing brackets. The bearing brackets are coupled together by releasable tension rods which transmit a pressing force. When the two press units are not transmitting a pressing force in a pressing plane, the tension rods are prestressed at a maximum of a fraction of the maximum pressing force. One of the bearing brackets is movable relative to the other bearing bracket along the pressing plane. The bearing brackets are guided by a pair of guide surfaces disposed parallel to the press plane.

20 Claims, 2 Drawing Sheets

15
16
12
6
3
11
4
20
10
15
3A
28
27
14
22
23
26
7
P
24
24
8
25
21
9
5d
F
5c
2
1A
1
1a
II
E
15
15

3b
3
12
4a
20
4
10
3A
7
6
27
23
28
22
P
9
21
4b
4c
29
9
3a
1A
2
5b
5a
15
2a
1
1a
5

PRESS HAVING GUIDE FOR BEARING BRACKETS

BACKGROUND OF THE INVENTION

The present invention relates to a roll press, preferably for the treatment of a traveling web, for instance a web of paper. The roll press comprises two press units, for example press rolls, the main axes of which lie in a pressing plane and form with each other a press nip through which the web travels. The roll press can also comprise three press units which form two press nips, or four press units which form three press nips.

The invention proceeds from a roll press having the following features. It is a roll press for the treatment of a traveling web of paper having two press units which may be in the form of press rolls. Each press unit, hereafter called a press roll, has a respective axis. The axes together lie in a press plane. The press rolls are so placed as to define a first press nip between them. One of the two press rolls includes a stationary support member that supports a traveling or circulating press element around the support member and that supports an internal pressing device for radially outwardly biasing the traveling or circulating press element toward the web and the other press roll. There are respective bearing brackets at each end of each of the press rolls. The bearing brackets at each end of the rolls are connected to each other by detachable tension bars which transmit the pressing force between the bearing brackets at the respective roll end. One set of the bearing brackets for one of the press rolls are rigidly supported on a machine frame or foundation and bear or support the weight of the other press roll. As prior art, reference is had to WO 92/17641 published after the priority date claimed.

The "main axis" of a press unit can, for instance, be the axis of rotation of a press-roll jacket or the longitudinal axis of the stationary support member of, for instance, a shoe-press unit (in the latter case, the axis of rotation can be arranged eccentrically relative to the main axis).

The "rotating press element" can be a metallic press-roll jacket which is rotatable around a stationary support member and is displaceable radially relative to it, or a traveling or circulating press belt or tubular traveling or circulating press jacket in the case of a shoe press unit.

The "internal pressing device" can be either a pressure chamber in the shape of a half ring or a row of radially movable support elements, or else an elongated radially movable press shoe.

The "one press unit", the bearing brackets of which are rigidly supported, is arranged on a frame, foundation or the like or is fastened (by means of its brackets) suspended from a (for instance, vertical or horizontal) support. The "other press unit" can be arranged above, to the side of, or below the rigidly supported press unit and its weight is borne by the bearing brackets of the rigidly supported press unit. The expression "rigidly supported" includes the bipartite bearing-bracket construction with axial guide elements in accordance, for instance, with Federal Republic of Germany Utility Model 92 04 405.0.

One essential feature of the roll press from which the present invention proceeds is that the bearing brackets are coupled to each other in pairs by means of detachable tension bars. These tension bars are the sole element for transmitting the pressing force from bearing bracket to bearing bracket. Thus, the machine frames of the roll press need be dimensioned only for the weight of the press units themselves, and not for the transmission of the pressing force. It is also important that the tension bars are easily detachable so that the tension bars, while in an unloaded condition thereby exerting zero pressing force, are preferably pretensioned to at most a fraction of the maximum pressing force.

Furthermore, these tension bars are in a certain sense movable or flexible so that the bearing brackets of the "other press unit" are movable parallel to the pressing plane relative to the bearing brackets of the rigidly supported press unit. This is in contradiction to the manner of construction in accordance with U.S. Pat. No. 3,921,514. In that patent, instead of easily detachable tension bars, bolted connections are provided which clamp the bearing brackets together. Thus, these bolted connections must be strongly prestressed already in the unloaded condition of the roll press. Such bolted connections are extremely bulky and expensive in highly loaded roll presses. Thus mounting and loosening of the bearing brackets can be effected only at enormous expense. In this connection, it must be borne in mind that such roll presses are preferably used in paper manufacturing machines, the width of which may in the extreme case be up to 10 m. In particular, many roll presses are developed as shoe presses in which the linear force prevailing in the press nip may reach an order of magnitude of 1000 kN/m. To complicate matters, in many cases an endless felt belt (serving for the removing of water from the web of paper) must pass through the press nip and such a felt belt must be replaced at certain time intervals by a new felt belt. Similarly, in the case of shoe presses, the rotating flexible (for instance, tubular) press element must be replaced from time to time. Due to the use of the easily detachable tension bars, this work can be carried out within a relatively short time, so that the roll press is quickly ready to operate again.

One disadvantage of this proposed construction is, however, that an exact positioning of the two bearing brackets relative to each other is not possible, even though guide cheeks are provided on the machine frame. In other words, there is the danger that the main axis of the "other" press unit having the movable bearing brackets does not lie (at least at times) precisely in the pressing plane. This has the result that the web is treated in a nonuniform manner over its width, and/or that the roll jackets become unevenly worn.

SUMMARY OF THE INVENTION

The object of the invention is, therefore, to improve the roll press described in WO '641 so that the main axis of the "other", i.e. the movable, press unit, always remains as precisely as possible in the pressing plane during operation.

In accordance with the object of the invention, the tension bars—in the unloaded condition of the roll press, and therefore with a pressing force of zero—are not prestressed at all or are prestressed only to a fraction (for instance, one-fifth) of the maximum pressing force. The bearing brackets of the one press unit are supported rigidly on the machine frame, while the bearing brackets of the other press unit are movable along the pressing plane during operation.

Two cases are to be distinguished. If the press unit having the movable bearing brackets (movable along the pressing plane) is located above the press unit which is rigidly supported on the machine frame, then, in the case of a pressing force of zero, the movable bearing brackets rest on the bearing brackets of the rigidly supported press unit located below them . In the other case, the movable bearing brackets are suspended by the tension bars from the bearing brackets located above the bearing brackets of the rigidly supported press unit which is in the top position. In this case, the tension bars are pretensioned by the weight of the lower press unit itself.

In order to achieve the object, the bearing brackets are "centered" with respect to each other by means of at least one guide surface which is parallel to the pressing plane and independent of the machine frame. In this way, the movability of the bearing brackets of the non-rigidly supported press unit along the pressing plane is retained. At the same time, however, the principal axes of both press units always remain precisely during the pressing plane in operation. Non-uniform treatment of the web or non-uniform wear of a roll jacket is thus avoided.

From GB 845,160, a rolling mill having two rolls having the following features is known. Each of the two rolls is supported via a rotatable journal pin in a bearing bracket. Each of the bearing brackets is provided on its outer sides with two large flat guide surfaces by which it can slide in a vertical direction on corresponding flat guide surfaces of a machine frame. The lower bearing bracket rests on the machine frame, which has, above the upper bearing bracket, a threaded spindle with a vertical axis of rotation. The threaded spindle engages on the upper bearing bracket so as to adjust the height of the roll nip and a spreading device presses the upper bearing bracket against the spindle. Additional tension bars are without load in this condition of operation and, in particular, during the rolling. The rolling pressure is thus not transmitted from bearing bracket to bearing bracket via the tension bars but, rather, via the threaded spindle and via the machine frame. As compared with the object of the present invention therefore, the above-described conventional device is an entirely different type of machine. In that case, provision is made for removing the two rolls together with the bearing brackets as a coherent structural group from the machine frame from time to time and then introducing them again (for instance, after repair). In order to facilitate the reintroduction, the outer guide surfaces of the two bearing brackets are held flush in the manner that the bearing brackets have additional guide surfaces which directly contact each other. The additional guide surfaces center the bearing brackets relative to each other, independently of the machine frame. During the rolling, it is, however, not possible to keep the two rolls parallel to each other solely by means of the additional guide surfaces. In this condition of operation, the outer guide surfaces which cooperate with the machine frame, are indispensable. In contrast the guide surfaces of the present invention are independent of the machine frame and are provided only or at least primarily on the bearing brackets. These guide surfaces are arranged centrally in that region of the roll press which lies close to the press nip (as seen in axial direction). In the normal operating condition, in which the roll press is under load and the tension bars are therefore under tension, the guide surfaces cooperate with the tension bars in such a manner that the bearing brackets are held with a high degree of precision in the correct position. In other words, both the transmission of the pressing force from bearing bracket to bearing bracket and the correct positioning of the "other" press unit (the bearing brackets of which are movable) take place completely independently of the machine frame.

In principle, it is sufficient for each bearing bracket to have only a single guide surface. In the simplest case, therefore, only a single pair of guide surfaces is present on each end of the roll press, the pair of guide surfaces being held in contact with each other by, for instance, spring force (or in the case of an inclined arrangement of the pressing plane) or by gravity. It is essential that each movable bearing bracket be positioned by a guide surface of the adjacent rigidly supported bearing bracket so that its main axis always lies in the pressing plane.

Further, two pairs of guide surfaces disposed parallel to the pressing plane are provided on each end of the roll press. Thus, the one bearing bracket can have a projection which engages into a recess in the other bearing bracket.

In accordance with a further development of the invention, however, a known removable intermediate piece is preferably provided between the two bearing brackets. This intermediate piece is, however, now developed as a so-called guide piece, i.e., the side surfaces of the block-shaped guide piece which are parallel to the pressing plane are now guide surfaces, since the guide piece engages—in a manner similar to a feather key between a shaft and hub—snugly in recesses in the two bearing brackets, to assure the correct position of the movable bearing brackets. The intermediate piece can be removed from the recesses if necessary, for instance, for a change of felt.

A spreading device which is provided, for instance, on the guide piece which can be used to produce a small pretensioning force in the tension bars before the roll press is placed in operation, so as to assure the correct position of the tension bars and of the movable bearing brackets with even greater accuracy.

BRIEF DESCRIPTION OF THE FIGURES

One embodiment of the invention will be described below with reference to the drawings, in which.

DETAILED DESCRIPTION OF THE PREFERRED EMBODIMENT

Figure 1:
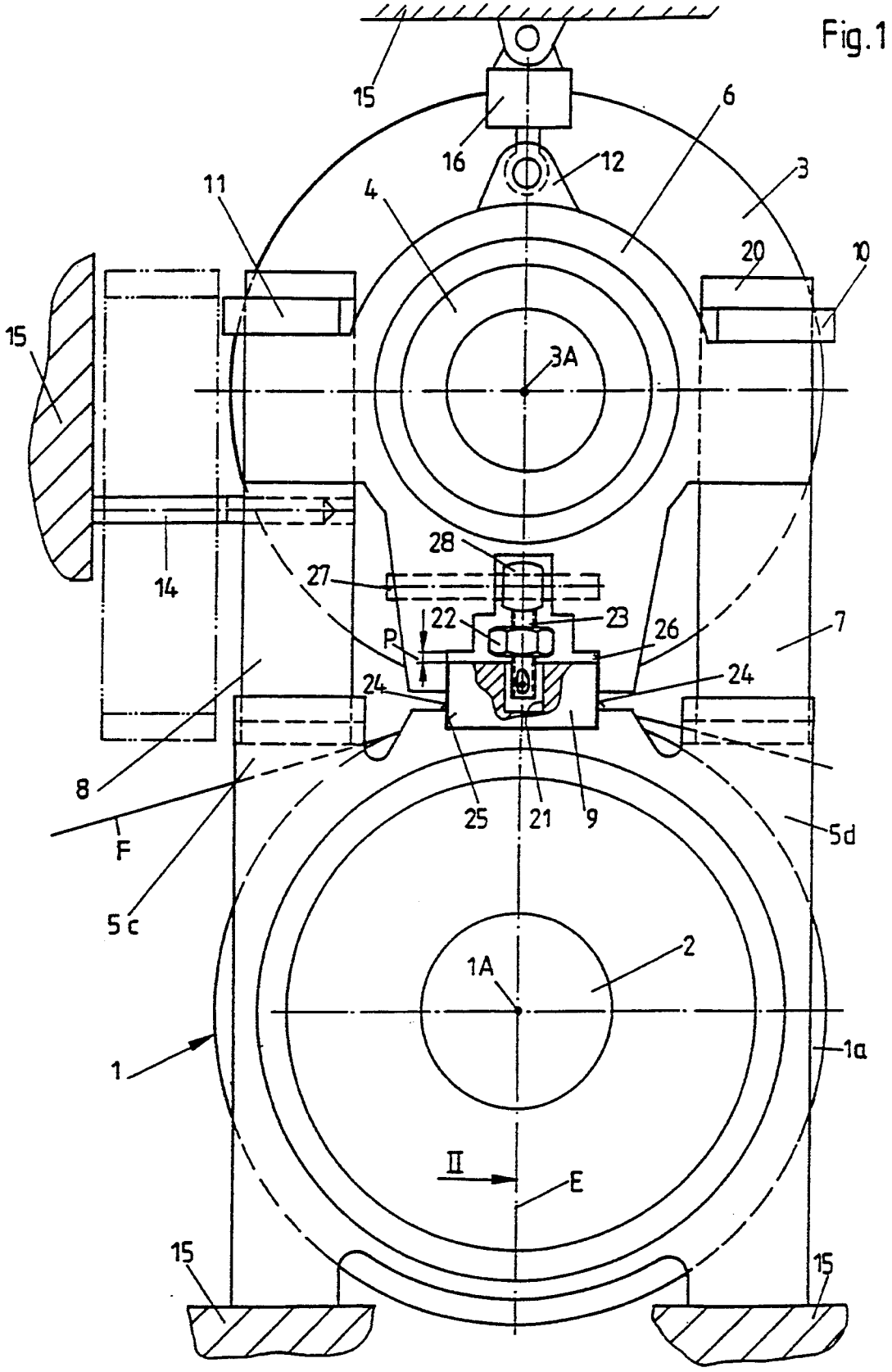
FIG. 1 is a view of one end of the roll press.

The roll press shown has a bottom, first press roll 1 and a top, second press roll 3. The axes of these press rolls lie in a pressing plane E. The first press roll 1 has a rotatable roll jacket 1*a* and a journal pin 2 fastened to it, the pin 2 resting by means of an antifriction bearing 2*a* in a bearing bracket 5 (having covers 5*a* and 5*b*). The bearing bracket 5 is arranged on a frame-shaped machine frame 15, a few portions of which are indicated in FIGS. 1 and 2.

The upper, second press roll 3 is a so-called long-nip press roll. Its roll jacket 3*a* is a tubular, flexible press jacket which is fastened on two turnable jacket support disks 3*b*. Each jacket support disk rests on the stationary journal pin 4 of a stationary support member 4*a* which extends through the inside of the roll jacket 3*a*. The support member 4*a* has a recess 4*b* facing the lower press roll 1 and a piston-like, hydraulically actuatable press shoe 4c therein. The concave slide surface of this shoe presses the press jacket 3a against the lower press roll 1 to form a lengthened press nip (lengthened in the direction of travel). Through this nip, there travels a web of paper from which the water is to be removed, together with at least one endless felt belt F. The upper press roll 3 rests (at each end of the roll) by means of the journal pin 4 also in a bearing bracket 6. Between the two bearing brackets 5 and 6 there is a removable block-shaped guide piece 9 which lies on the bearing bracket 5. The bearing bracket 6 of the upper press roll 3 rests on this guide piece 9 when the roll press is in its unloaded condition (i.e., when the recess 4b is without pressure). However, the loaded condition in which the press shoe 4c exerts a pressing force on the lower press roll 1 is shown in the drawing. The forces of reaction which result therefrom are transmitted from the upper bearing bracket 6 to the lower bearing bracket 5 by means of flexurally soft tension bars 7 and 8. The upper bearing bracket 6 is raised in this state by the distance p from the intermediate piece 9.

Figure 2:
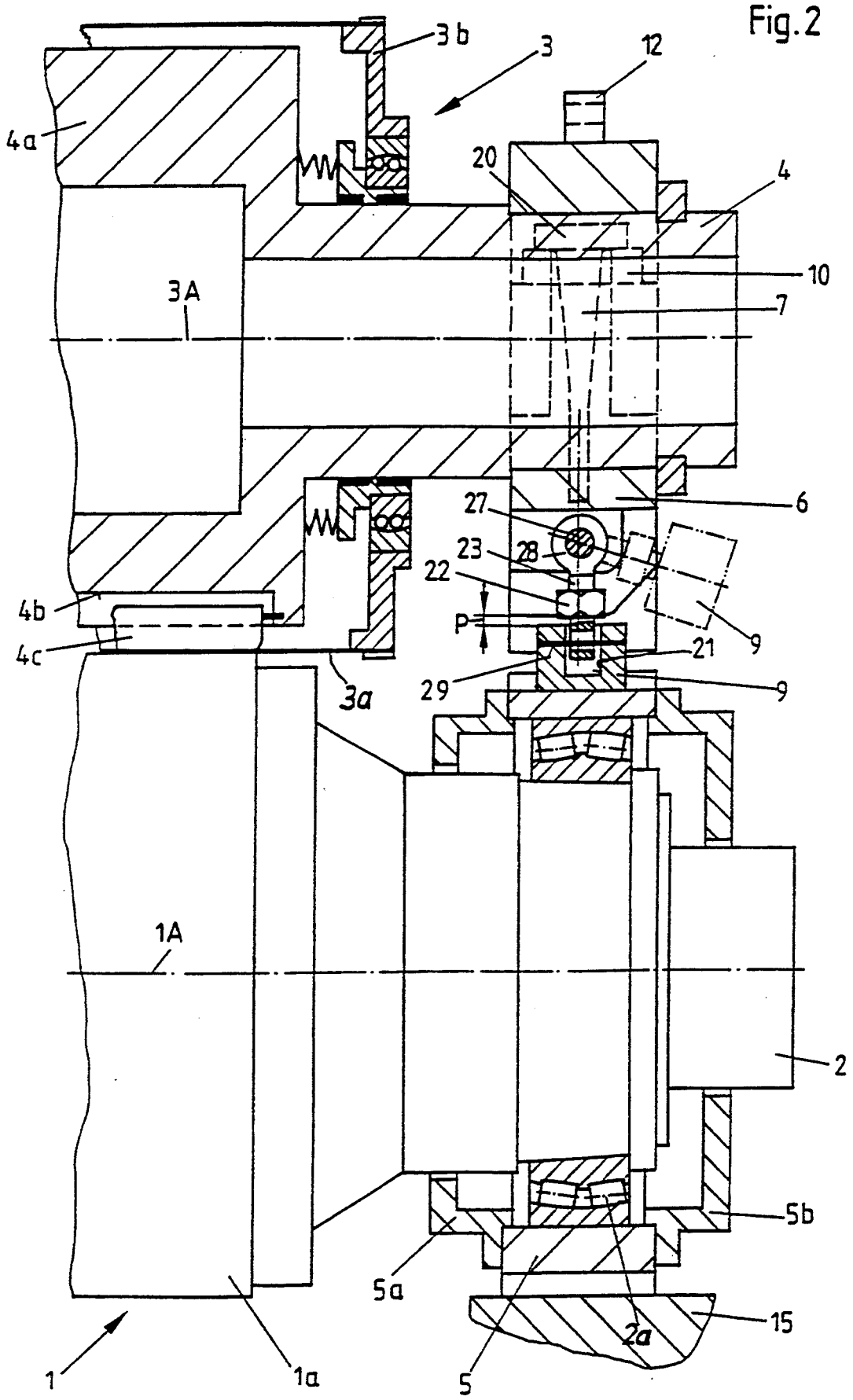
FIG. 2 is a longitudinal section along the line II of FIG. 1.

As shown in FIG. 1, a flexurally soft tension bar 7, 8 is provided on each side of the pressing plane E. These tension bars, as well as U-shaped intermediate pieces 10, 11, are inserted from the side into recesses in the bearing brackets 5 and 6. (The lower bearing bracket 5 has arms 5c and 5d in which T-grooves are provided.) Each of the flexurally soft tension bars 7, 8 is provided on each of its ends with a hammer head 20 and is developed preferably in the manner of a leaf spring, the "leaf plane" of which is perpendicular to the pressing plane E. In this way, the tension bars 7, 8 can deform if the support member 4, 4a of the second press roll 3 experiences a change in length (for instance, caused by heat) and/or bends under the pressing force. Accordingly, the upper bearing bracket 6 can be rigidly fastened to the journal pin 4. Thus, the axial slide surface necessary in conventional devices and located between these two structural parts, as well as, a spherical socket can be omitted. However, it should be emphasized that the invention can be used even if the the axial slide surface and the spherical socket are present, in which case the tension bars need not be flexurally soft. For the aforementioned guide piece 9, a recess 25 is provided, as shown in FIG. 1, in the lower bearing bracket 5, the recess having side surfaces which are parallel to the pressing plane E. Similarly, facing the recess 25, there is provided in the upper bearing bracket 6, a recess 26 which also has side surfaces which are parallel to the pressing plane E. The distances between the side surfaces in the two recesses 25 and 26 are preferably the same. Therefore, the block-shaped intermediate piece 9 fits with its side surfaces 24, which are also parallel to the pressing plane E, in both recesses 25 and 26. The drawing shows this arrangement only at one of the two ends of the roll press. It is understood, however, that the same arrangement is present at the other end. As a whole, therefore, the result is thus obtained that the principal axes 1A and 3A of the two rolls 1 and 3 always lie precisely in the pressing plane E. This is true even if, with the roll press not under load created by tension bars 7 and 8, there is only a relatively loose connection between the bearing bracket 5 and 6. The "centering" of the bearing brackets 5, 6 in accordance with the invention can also be employed in the event of an oblique arrangement of the roll press, as described in the priority patent application DE P 41 40 879.9.

Differing from the drawing, one can, under certain conditions, also dispense with having the guide piece 9 being removable and instead form the guide piece 9 to be a single structural part with the bearing bracket 5. In other words, the guide piece 9 can form the projection developed on the bearing bracket 5. In accordance with another alternative (not shown in the drawing), the guide piece is divided by a horizontal separating line into an upper section and a lower section. In this embodiment, only the lower section performs the guide function and therefore engages into both recesses 25 and 26. The height of the upper section can be adjusted by a spreading device.

However, the embodiment shown which has the following features is preferred. A swivel shaft 27 which is perpendicular to the pressing plane E is fastened in the upper bearing bracket 6. The head 28 of a threaded spindle 23 is mounted for rotation on the shaft so that the axis of the threaded spindle always lies in the pressing plane E (or at a slight distance from and parallel to it). The threaded spindle 23 extends into a hole 21 provided in the guide piece 9. A spindle nut 22 can come into contact with the guide piece 9 by rotating on the spindle 23. In this way, in the unloaded condition of the roll press, a slight initial tension can be applied to the tension bars 7, 8, which tension is retained if the pressing force is temporarily reduced to zero during operation. In such case, therefore, the bearing bracket does not rest directly on the guide piece 9 but rests on it indirectly via swivel shaft 27, spindle 23 and spindle nut 22.

When a new felt F must be placed in the roll press, the following procedure is performed: First of all, by means of a lug 12 and a hydraulic cylinder 16 which is suspended from the machine frame 15, the upper press roll 3 is lifted somewhat so that the spindle nut 22 can be loosened from the guide piece 9 by rotating on the spindle 23. The press roll is then lowered until the bearing bracket 6 rests directly on the guide piece 9. The tension bars 7, 8 and intermediate pieces 10, 11 can now be removed. For example, the tie bar 8 is pushed onto a bolt 14 which is fastened on the machine frame 15. The upper press roll 3 is now again lifted by means of the hydraulic cylinder 16. The guide piece 9 can now be swung upward to the side together with the spindle 23, as shown in dash-dot line in FIG. 2. In this connection the guide piece 9 remains continuously connected to the spindle 23 by means of a small bolt 29 which extends transversely through the guide piece 9 and the spindle 23.

The spreading device includes the parts 22, 23, 27, 28 and can also be arranged below the guide piece 9 in the bearing bracket 5 so that the swinging out of the guide piece occures in a lateral downward direction.

I claim:

1. A press for the treatment of a traveling paper web, the press comprising:

a first press unit having a first axis and a second press unit having a second axis, the first and second axes lying in a pressing plane, the first and second press units being placed with respect to each other for defining a press nip through which the web travels;

the first press unit including a stationary support member, a traveling press element supported on and traveling around the support member for defining a jacket for cooperating in the press nip with the second press unit; an internal pressing device located at the support member movable for causing such radial movement of the traveling press element as to create the press nip and to produce a pressing force that acts on the web in the press nip;

each of the first and second press units having opposite ends; respective first bearing brackets at the ends of the first press unit and respective second bearing brackets at the ends of the second press unit;

detachable tension bars at the ends of the press units including a respective tension bar coupling the first and second bearing bracket at each end of the press unit, the tension bar serving for transmitting pressing force between the bearing brackets; the tension bars being pretensioned to at most a fraction of the maximum pressing force in the event of the occurrence of a zero pressing force;

the first bearing brackets being rigidly supported on a press frame for supporting the first press unit and for supporting at least part of the weight of the second press unit;

at least one of the second bearing brackets is movable relative to at least one of the first bearing brackets along the pressing plane, both the at least one first bearing bracket and the at least one second bearing bracket located at the same end of the press, and in the loaded condition of the press, the at least one second bearing bracket is moved away from the at least one first bearing bracket to provide a spacing distance between the at least one first and at least one second bearing brackets, the at least one second bearing bracket having a guide surface;

guiding means for guiding the bearing brackets of the first and second press units to move relative to each other along a path parallel to the pressing plane, the guiding means including a guide surface which lies parallel to the pressing plane for engaging the guide surface of the at least one second bearing bracket for guiding the movement of the at least one first and at least one second bearing brackets parallel to the pressing plane and a removable guide piece disposed between the at least one first and the at least one second bearing brackets, the guide peice having the guide surface of the guide means at one side thereof oriented to extend parallel to the pressing plane.

2. The press of claim 1, wherein the guide surface of the guiding means is independent of the press frame.

3. The press of claim 1, wherein, as seen in the direction of the axes of the first and second press units, at least one of the at least one first and at least one second bearing brackets has a recess therein, the recess having a side surface for cooperating with the guide surface of the guide piece.

4. The press of claim 3, further comprising a spreading device between the at least one first and at least one second bearing brackets for spreading the at least one first and at least one second bearing brackets apart.

5. The press of claim 4, further comprising a threaded spindle connecting the at least one first bearing bracket to the guide piece.

6. The press of claim 5, wherein the guide piece has a hole defined in it into which the threaded spindle extends; a spindle nut threadedly received on the threaded spindle and turnable against the guide piece for adjusting the spindle in the guide piece to set a spacing apart of the at least one first and at least one second bearing brackets.

7. The press of claim 6, further comprising a swivel shaft perpendicular to the pressing plane and fixed within one of the at least one first and at least one second bearing brackets and the threaded spindle being swingably supported on the swivel shaft for swinging the spindle and the guide piece around the swivel shaft for moving the guide piece from a location between the at least one first and at least one second bearing brackets.

8. The press of claim 1, wherein, as seen in the direction of the axes of the first and second press units, both of the at least one first and at least one second bearing brackets have a respective recess therein, the recess having a side surface for cooperating with the guide surface of the guide piece.

9. The press of claim 1, further comprising a spreading device between the at least one first and at least one second bearing brackets for spreading the bearing at least one first and at least one second bearing brackets apart.

10. The press of claim 9, further comprising a threaded spindle connecting one of the at least one first and at least one second bearing brackets to the guiding means.

11. The press of claim 1, wherein at least one of the press units comprises a press roll.

12. The press of claim 1, wherein at least the second press unit comprises a press roll.

13. The press of claim 1, wherein each of the first and one second press units comprises a press roll.

14. A press for treating a traveling paper web, the press comprising:

a first press unit having a first axis and a second press unit having a second axis, the first and second axes lying in a pressing plane, the first and second press units being placed with respect to each other for defining a press nip through which the web travels;

the first press unit including a stationary support member, a traveling press element supported on and traveling around the support member for defining a jacket for cooperating in the press nip with the second press unit; an internal pressing device located at the support member movable for causing such radial movement of the traveling press element to create the press nip and to produce a pressing force that acts on the web in the press nip;

each of the first and second press units having opposite ends; respective first bearing brackets at the ends of the first press unit and respective second bearing brackets at the ends of the second press unit;

detachable tension bars at the ends of the press units including a respective tension bar coupling the first and second bearing bracket at each end of the press unit, the tension bar serving for transmitting pressing force between the bearing brackets; the tension bars being pretensioned to at most a fraction of the maximum pressing force in the event of the occurrence of a zero pressing force;

the first bearing brackets being rigidly supported on a press frame for supporting the first press unit and for supporting at least part of the weight of the second press unit;

at least one of the second bearing brackets is movable relative to at least one of the first bearing brackets along the pressing plane, both the at least one first bearing bracket and the at least one second bearing bracket located at the same end of the press, and in the loaded condition of the press, the at least one second bearing bracket is moved away from the at least one first bearing bracket to provide a spacing distance between the at least one first and at least one second bearing brackets; and a guiding device disposed between the at least one first and at least one second bearing brackets for guiding the at least one first and at least one second bearing brackets of the first and second press units as the at least one second bearing bracket moves relative to the at least one first bearing bracket along a path parallel to the pressing plane.

15. The press of claim 14, wherein the guiding device comprises a guide surface which lies parallel to the pressing plane to center the at least one first and at least one second bearing brackets relative to each other.

16. The press of claim 14, wherein the guiding device is independent of the press frame.

17. The press of claim 14, wherein the at least one first and the at least one second bearing brackets have a recess formed therein and the guiding device fits within the recess formed in each of the at least one first and the at least one second bearing brackets.

18. The press of claim 14, further comprising a threaded spindle connecting the at least one first bearing bracket to the guiding device and a spreading device located between the at least one first and the at least one second bearing brackets for spreading the first at least one and the at least one second bearing brackets apart.

19. The press of claim 14, wherein at least one of the first and second press units comprises a press roll.

20. A press for treating a traveling paper web, the press comprising:

a first press unit having a first axis and a second press unit having a second axis, the first and second axes lying in a pressing plane, the first and second press units being placed with respect to each other for defining a press nip through which the web travels;

the first press unit including a stationary support member, a traveling press element supported on and traveling around the support member for defining a jacket for cooperating in the press nip with the second press unit; an internal pressing device located at the support member movable for causing such radial movement of the traveling press element to create the press nip and to produce a pressing force that acts on the web in the press nip;

each of the first and second press units having opposite ends; respective first bearing brackets at the ends of the first press unit and respective second bearing brackets at the ends of the second press unit;

detachable tension bars at the ends of the press units including a respective tension bar coupling the first and second bearing bracket at each end of the press unit, the tension bar serving for transmitting pressing force between the bearing brackets; the tension bars being pretensioned to at most a fraction of the maximum pressing force in the event of the occurrence of a zero pressing force;

the first bearing brackets being rigidly supported on a press frame for supporting the first press unit and for supporting at least part of the weight of the second press unit; at least one of the second bearing brackets is movable relative to at least one of the first bearing brackets along the pressing plane, both the at least one first bearing bracket and the at least one second bearing bracket located at the same end of the press and in the loaded condition of the press, the at least one second bearing bracket is moved away from the at least one first bearing bracket to provide a spacing distance between the at least one first and at least one second bearing brackets; and a guiding device located within the pressing plane for guiding the at least one first and at least one second bearing brackets of the first and second press units as the at least one second bearing bracket moves relative to the at least one first bearing bracket along a path parallel to the pressing plane.

* * * * *